US006953418B1

(12) United States Patent
Chen

(10) Patent No.: US 6,953,418 B1
(45) Date of Patent: Oct. 11, 2005

(54) SHOCK ABSORPTION DEVICE OF A RUNNING APPARATUS

(76) Inventor: Wen-Ho Chen, 45 Chung-Shan Road, Feng-Yuan (TW) 420

( * ) Notice: Subject to any disclaimer, the term of this patent is extended or adjusted under 35 U.S.C. 154(b) by 10 days.

(21) Appl. No.: 10/813,095

(22) Filed: Mar. 31, 2004

(51) Int. Cl.[7] ..... A63B 71/00
(52) U.S. Cl. ..... 482/51; 452/54
(58) Field of Search ..... 482/26, 27, 30, 482/32, 51, 54, 77, 148, 121–123, 129; 623/27; 446/486

(56) References Cited

U.S. PATENT DOCUMENTS

| | | | | |
|---|---|---|---|---|
| 5,072,928 A | * | 12/1991 | Stearns et al. | 482/54 |
| 5,336,144 A | * | 8/1994 | Rodden | 482/54 |
| 5,372,560 A | * | 12/1994 | Chang | 482/54 |
| 5,827,155 A | * | 10/1998 | Jensen et al. | 482/54 |
| 5,993,358 A | * | 11/1999 | Gureghian et al. | 482/54 |
| 6,821,230 B2 | * | 11/2004 | Dalebout et al. | 482/51 |

OTHER PUBLICATIONS

Liu et al., Treadmill with a Shock-Absorbing and Cushioning Structure, Apr. 17, 2003, Pub. No. US 2003/0073545 A1.*

Pan et al., Passive shock Absorber For Treadmill, Dec. 2, 2004, Pub. No. Us 2004/0242378 A1.*

Dyer et al., Treadmill Cushion, Jan. 24, 2002, Pub. No. Us 2002/0010055 A1.*

Nerio et al., Support Device, with Damping, For a Mobile Part of an Exercise Apparatus, Mar. 25, 2004, Pub. No. 2004/0058786 A1.*

* cited by examiner

*Primary Examiner*—Gregory L. Huson
*Assistant Examiner*—Tam Nguyen

(57) ABSTRACT

A shock absorption device of a running apparatus is provided with a shock absorbing elastic member at the rear side thereof. The shock absorption device includes a foot pedal, a lifted base, a support frame and an elastic member. The lifted base is disposed under the foot pedal and the support frame is attached to the bottom of the lifted base. The elastic member is connected to the support frame with a pivotal shaft. When the user runs on the foot pedal, the foot pedal can be lifted an inclining angle with the lifted base rotating with respect to the pivotal shaft to mitigate an impact force caused by the elastic member so as to protect the knees and ankles from injury.

2 Claims, 10 Drawing Sheets

SHOCK ABSORPTION DEVICE OF A RUNNING APPARATUS

BACKGROUND OF THE INVENTION

1. Field of the Invention

The present invention is related to a shock absorption device of a running apparatus and particularly to a shock absorption device, which is provided with a shock absorbing elastic member at the rear side of a running apparatus to protect the knees of the user from injury.

2. Brief Description of the Related Art

The running apparatus has become one of basic fittings for indoor sports nowadays but there is deficiency in the currently used running apparatus. Due to the moving human body being incompatible for high speed operation of the running apparatus, it often occurs the ankles and the knees being hurt. It is known that the body moves and the ground is stationary during a person running for taking exercise on the ground and the body can move forward after the feet touching the ground and keeping the body being in a steady state. However, the foot pedal of the running apparatus keeps moving while the runner keeps moving on the foot pedal during running and the runner has to adjust movements of the ankles and the knees to comply with moving speed of the foot pedal in a way of the upper part of the body keeping unmoving. Hence, it is very easy for the ankles and the knees to get hurt during the feet trying to keep the body in a state of balance and to support the body weight. In addition, the foot pedal is made of hard metal and once the feet contact the foot pedal, injury at the ankles and knees becomes more serious due to acceleration of gravity exerted by the body.

Referring to FIG. 1, one of the conventional running apparatus is illustrated to add with a cushion design for decreasing burden of foot joints and knee joints against the acceleration of gravity in order to overcome the preceding deficiency of the ankles and the knees being easily getting hurt. The running apparatus 10 provides a foot pedal 11 is fixedly attached to the a lifted base 14 and an elevation device 12 is disposed at the front side of the lifted base 14 with a fulcrum roller 13 at the rear side of the lifted base 14. When the elevation device 12 moves upward and downward, the fulcrum roller 13 acts as a fixed rotational shaft during the foot pedal 11 forming an inclining position or a horizontal position.

The running apparatus disclosed in Taiwanese Patent Application Nos. 92204569 and 91221543 are provided with a suspension component and a cushion member in the elevation device 12 of the preceding conventional running apparatus to offset the acceleration of gravity generated by the body weight by way of elasticity during the user running on the foot pedal so as to protect the ankles and the knees. However, the revised elevation device 12 has affected the whole structure of the running apparatus and has to change relative motion between the elevation device 12 and rest parts in the running apparatus. Hence, it adds difficulty to make a change and high fabrication cost of the running apparatus.

Referring to FIGS. 2 and 3, a recently improved running apparatus provides a soft pad 15, which is disposed under the lifted base 14, to be supported with a circular member 16 therein for strengthen the soft pad 15. The circular member 16 has a screw 17 at the center thereof for fastening the bottom of the running apparatus. A joining surface 18 between the circular member 16 and the lifted base 14 should not be covered with the soft pad 15, otherwise, it is hard to obtain a required tightness between the circular member 16 and the lifted base 14. Thus, the preceding arrangement has the following shortcomings:

1. It is not possible for the exposed soft pad to be fixedly attached to the bottom of running apparatus with a tool such that it results in unfavorable steadiness of the running apparatus.
2. The soft pad is damaged easily under being subjected a force such that it has to face a risk of loosening. If a tool is used for fixing the soft pad, it is easy to break the soft pad.
3. The soft pad provides a thickness only enough for decreasing noise resulting from impact and reducing the sound decibel.
4. The soft pad easily detaches from the circular member under a force in case of the joining surface being covered with the soft pad in addition to improper engagement.

SUMMARY OF THE INVENTION

An object of the present invention is to provide a shock absorption device of a running apparatus with which a simple elastic member is mounted at the bottom of the running apparatus to perform more effective shock absorption easily for various brands of running apparatuses in different sizes and to lower the fabrication cost thereof.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE PREFERRED EMBODIMENTS

Figure 1:
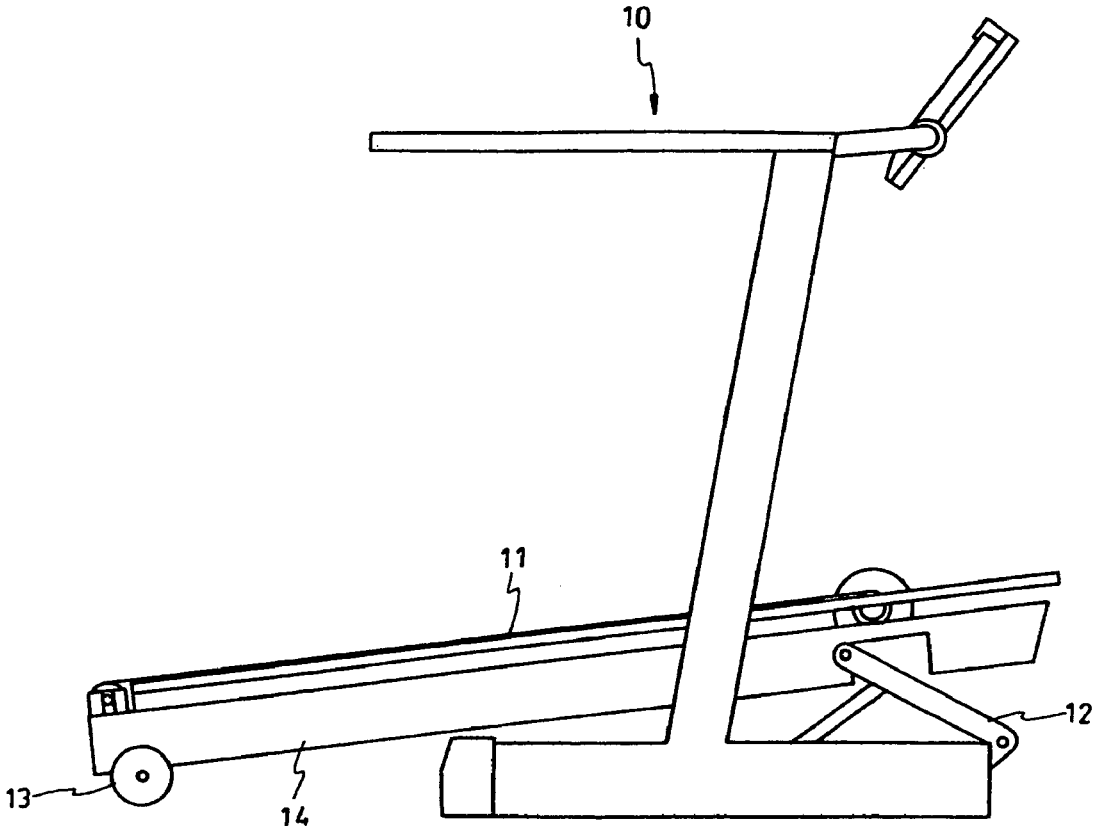
FIG. 1 (PRIOR ART)
FIG. 1 is a plan view of a conventional running apparatus.
Figure 2:
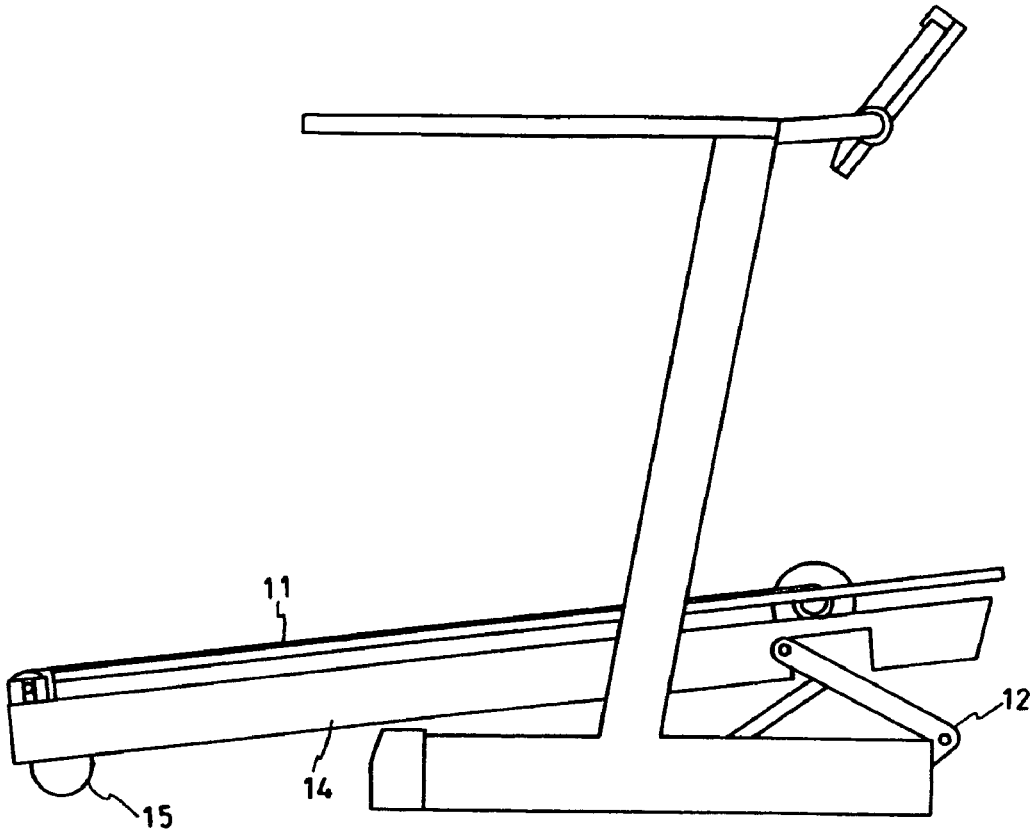
FIG. 2 (PRIOR ART)
FIG. 2 is a plan view of another conventional running apparatus.
Figure 3:
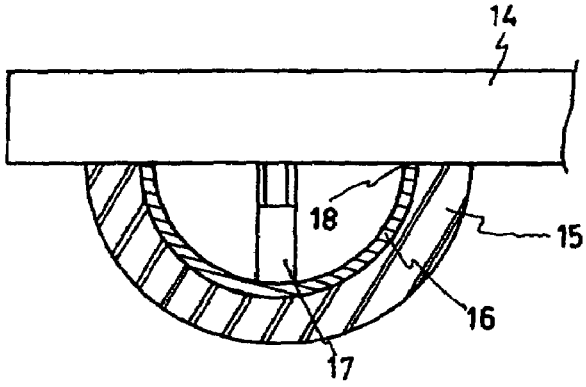
FIG. 3 (PRIOR ART)
FIG. 3 is a sectional view of a cushion pad in the running apparatus shown in FIG. 2.
Figure 4:
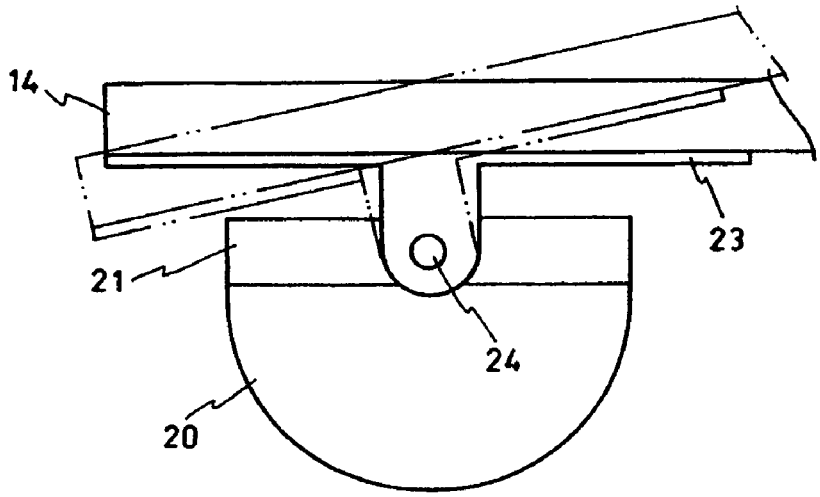
FIG. 4 is a plan view of a shock absorption device in a preferred embodiment according to the present invention.

Referring to FIG. 4, the first preferred embodiment of a shock absorption device of a running apparatus according to the present invention is illustrated. It can be seen in FIG. 4 that a support frame 23 is provided at the bottom of the lifted base 14 with a reinforced member 21 being joined to the pivotal shaft 24 of the support frame 23 and an elastic member 20 is disposed under the reinforced member 21. The function of shock absorption can be enhanced by way of the thickness of the elastic member 20 being increased. Further, the pivotal shaft 24 can retain the lifted base 14 at a fixed position and the circular surface of the elastic member 20 is capable of providing an auxiliary function for the lifted base 14 to turn an angle.

When the user runs on the running apparatus, the elastic member 20 is in a state of alternately being compressed and stretching to perform the function of shock absorption because of the elastic member 20 having a greater thickness. Thus, the lifted base 14 at a side of the elastic member 20 can move downward and upward to relieve the ankles and the knees from occurred impact during running so as to protect the ankles and the knees from getting hurt and overcome the shortcoming of the prior art, which can reduce noise only.

Figure 5:
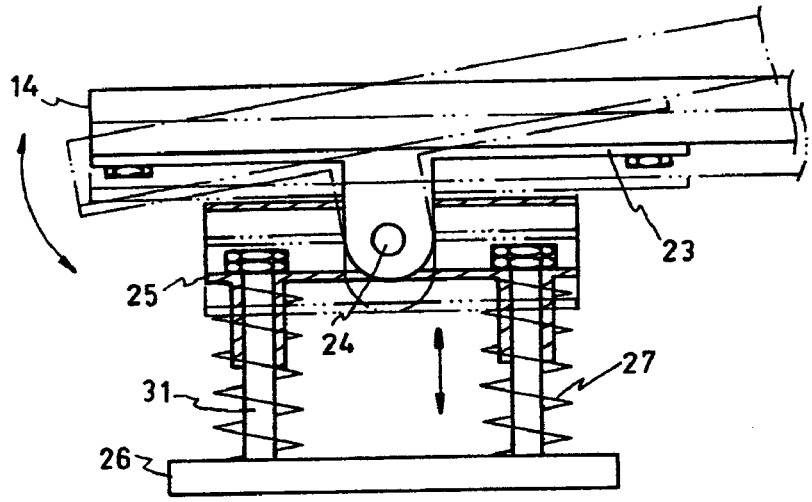
FIG. 5 is a plan view of a shock absorption device in another preferred embodiment according to the present invention.

Referring to FIG. 5, another preferred embodiment of the shock absorption device according to the present invention is illustrated. A support frame 23 is provided at the bottom of the lifted base 14 and a pivotal shaft 24 is disposed at the middle position of the support frame 23 to be joined to a cushion seat 25. A foot base 26 is disposed under the cushion seat 25 and slide rods 31 are disposed in between to join the cushion seat 25 and the foot base 26 together. An elastic member 27 is arranged to surround each of the slide rods 31.

The lifted base 14 rotates with respect to the pivotal shaft 24 during ascending and descending to keep the horizontal stability of the shock absorption device. In case of the lifted base 14 ascending and forming an inclining position, it is not possible for the lifted base 14 to touch the shock absorption device so that a smooth movement of the lifted base 14 can be obtained. In case of the lifted base 14 descending under force and the cushion seat 25 moving downward and compressing the elastic member 27, the slide rods 31 can partly insert into the cushion seat 25. The cushion seat 25 and the lifted base 14 are pushed backward due to rebounding power of the elastic member 27 while no force is executed so that the pressing down force can be absorbed to perform the function of cushion and the foot base 26 can keep steady to support the lifted base 14.

Figure 6:
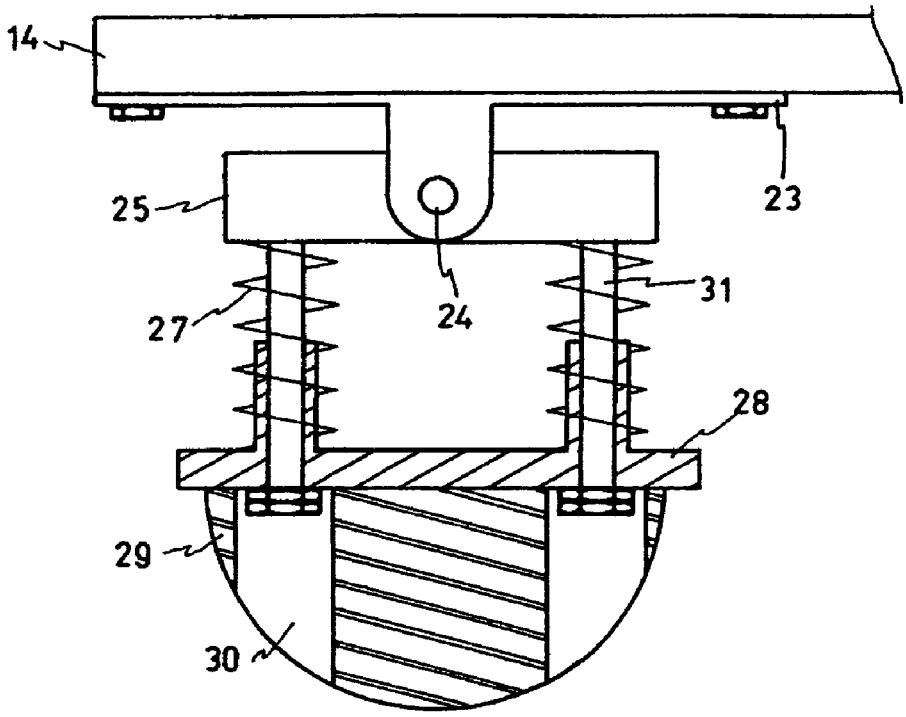
FIG. 6 is a sectional view of a shock absorption device in a further preferred embodiment according to the present invention.

Referring to FIG. 6, a further preferred embodiment of the shock absorption device according to the present invention is illustrated. The support frame 23 has a pivotal shaft 24 at the middle position thereof to join with a cushion seat 25 and a support base 28 is disposed below the cushion seat 25 with an elastic member 27 being arranged between the support base 28 and the cushion seat 24. Another elastic member 29 is arranged under the support base 28 with a receiving space 30 therein and lower part of the slide rods 31 can enter the receiving space 31 and move forward and backward in the receiving space 30 while the cushion seat 25 moves downward so as to perform the function of cushion during the lifted base 14 moving upward and downward. In the mean time, sensitivity of cushion can be enhanced by way of both the elastic members 27, 29 to achieve an effect of prevention of sport injury.

Figure 7:
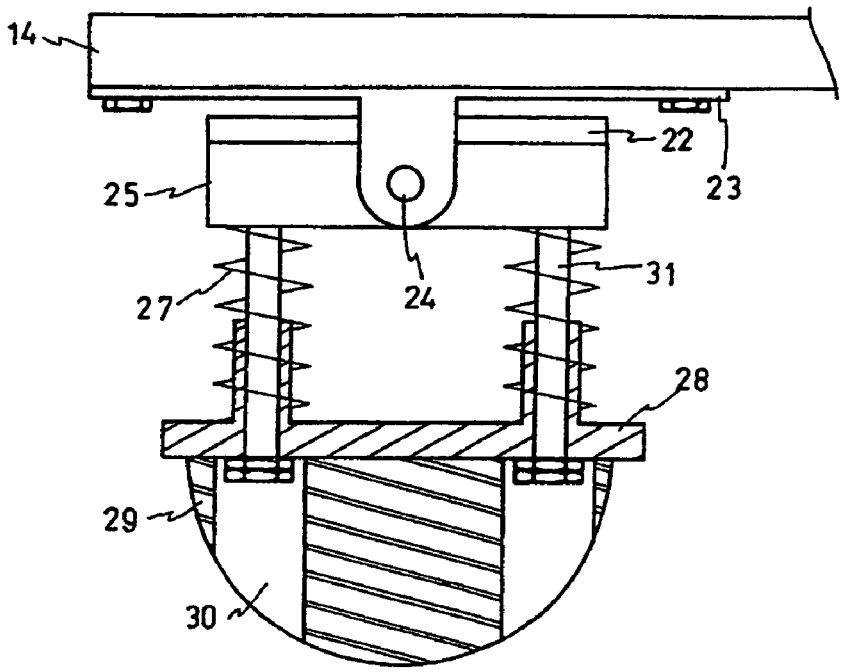
FIG. 7 is a sectional view of a shock absorption device in a further preferred embodiment according to the present invention.

Referring to FIG. 7, a further embodiment of the present invention is illustrated. A soft pad member 22 is arranged on the cushion seat 25. When the lifted base 14 rotates with respect to the pivotal shaft 24, the soft pad 22 can eliminate impact sound caused by the support frame 23 hitting the cushion seat 25 and protect the shock absorption device from damage due to impact. In addition, the lifted base 14 can contact the cushion seat 25 via the soft pad 22 to lighten load of the pivotal shaft 24. Especially, when the lifted base 14 moves upward to form an inclining angle, which results in change of executing force, and the body weight and gravity increase the load acting the pivotal shaft during running, the lifted base 14 contacts with the cushion seat 25 to lessen action of the load and the circular surface of the elastic member 29 becomes the rotational surface instead of the pivotal shaft 24. Hence, no impedance is produced during the lifted base 14 ascending.

Figure 8:
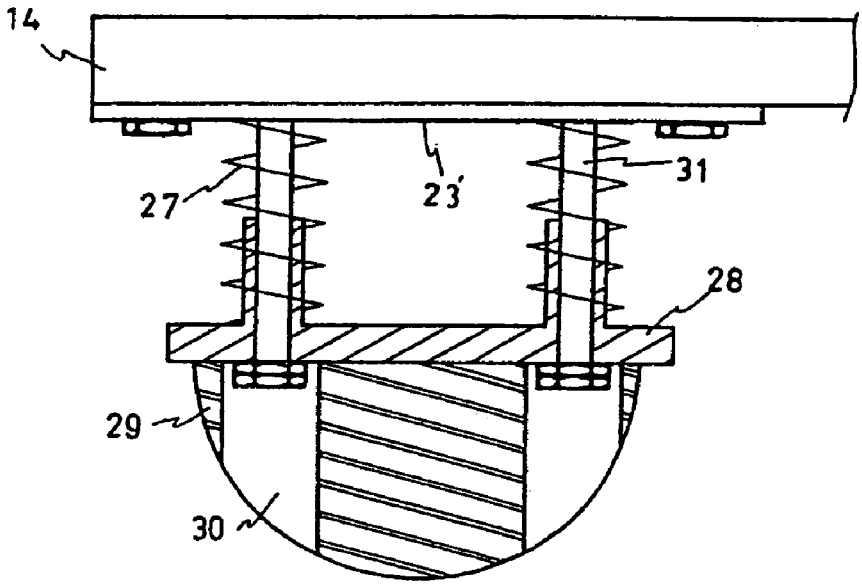
FIG. 8 is a sectional view of a shock absorption device in a further preferred embodiment according to the present invention.

Referring to FIG. 8, a further embodiment of the shock absorption device according to the present invention is illustrated. The slide rods 31 are provided on the support frame 23' such that the circular surface of the elastic member 29 becomes the rotational surface during the lifted base 14 rotating and forming an inclining angle. It is noted that the present embodiment has the same function as the preceding embodiment.

Figure 9:
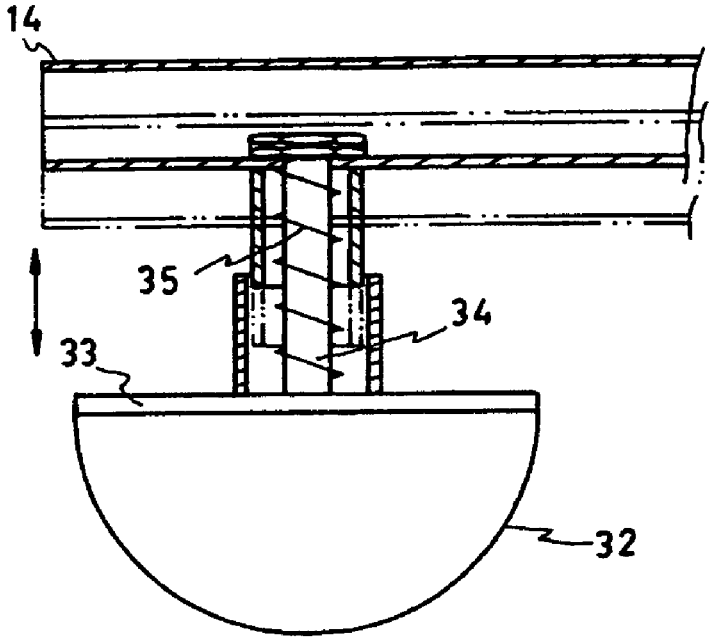
FIG. 9 is a sectional view of a shock absorption device in a further preferred embodiment according to the present invention.

Referring to FIG. 9, a further embodiment is illustrated. The upper end of an elastic member 32 has a support base 33 with a slide rod 34 and another elastic member 35 is arranged to surround the slide rod 34. The slide rod 31 extends into the lifted base 14 and can provide more sensitive shock absorption. The lifted base 14 rotates with respect to the circular surface of the elastic member 32 during ascending.

Figure 10:
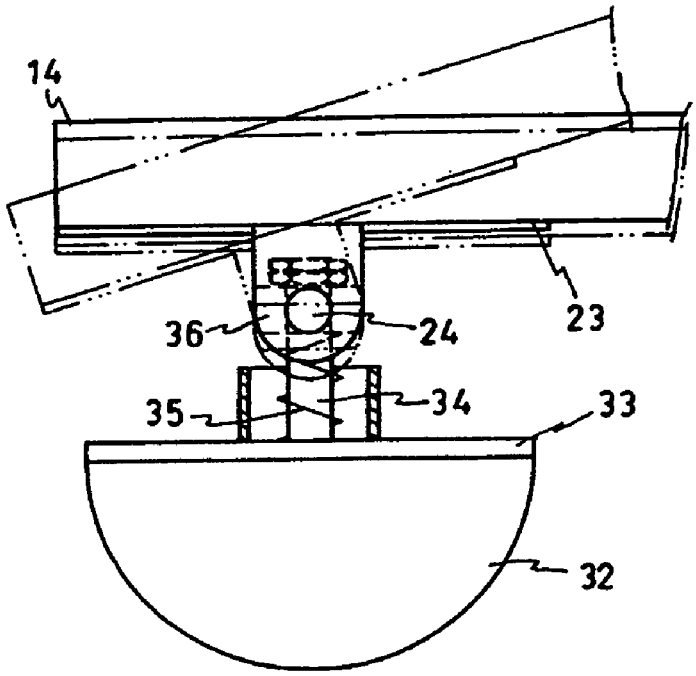
FIG. 10 is a sectional view of a shock absorption device in a further preferred embodiment according to the present invention.

Referring to FIG. 10, a further embodiment is illustrated. A support frame 23 with a pivotal shaft 24 is provided under the lifted base 14 and a slide limit piece 36 is provided at center of the pivotal shaft 24 for a slide rod 34 sliding therein. The lifted base 14 rotates with respect to the pivotal shaft 24 during ascending.

While the invention has been described with referencing to preferred embodiments thereof, it is to be understood that modifications or variations may be easily made without departing from the spirit of this invention, which is defined by the appended claims.

What is claimed is:

1. A shock absorption device for a running apparatus, the device comprising:

a support frame, being provided at a bottom side of a lifted base of a running apparatus that is resting on a support surface;

a cushion seat, being pivotably attached to a middle portion of the support frame via a pivotal shaft;

a support base having two upwardly protruding cylindrical openings, each with a first diameter, being provided at a distance below the cushion seat;

at least one slide rod, having an upper end and a lower end, being disposed in the cylindrical openings between and connecting with the support base and the cushion seat, and the slide rod being surrounded with a first elastic member respectively, the slide rod includes a member fixedly attached to said lower end wherein the member has a diameter that is larger than said cylindrical openings; and and a second elastic member having a dome shape, being provided at a bottom side of the support base, has a receiving space available for the slide rod moving in and out thereof;

whereby when the lifted base of the running apparatus is angularly elevated or lowered relative to the support surface, the pivotal shaft allows for the shock absorption device to maintain a substantially upright position such that an impact force on the lifted base can be mitigated more sensitively by the first and second elastic members.

2. The shock absorption device for of a running apparatus as defined in claim 1, wherein the cushion seat is provided with a soft pad member.

* * * * *